United States Patent [19]

Tanner et al.

[11] 4,371,109

[45] Feb. 1, 1983

[54] TWO-CELL BULK CONTAINER TUBES

[75] Inventors: Donald M. Tanner, Lakewood, Calif.; Herbert M. Potts, Yulee, Fla.

[73] Assignee: Container Corporation of America, Chicago, Ill.

[21] Appl. No.: 266,497

[22] Filed: May 22, 1981

[51] Int. Cl.[3] ..... B65D 5/32; B65D 13/00

[52] U.S. Cl. ..... 229/28 R; 229/23 R

[58] Field of Search ..... 229/23 R, 15, 27, 28 R

[56] References Cited

U.S. PATENT DOCUMENTS

| | | | |
|---|---|---|---|
| 2,327,529 | 8/1943 | Kieckhefer | 229/15 |
| 2,361,650 | 10/1944 | Potts | 229/27 |
| 2,491,206 | 12/1949 | Potts | 229/15 |
| 3,744,701 | 7/1973 | Taylor | 229/23 R |
| 3,904,105 | 9/1975 | Booth | 229/15 |
| 4,037,775 | 7/1977 | Bamburg | 229/23 R |
| 4,046,307 | 9/1977 | Booth | 229/15 |
| 4,165,030 | 8/1979 | Bunger | 229/23 R |
| 4,174,803 | 11/1979 | Shrontz | 229/23 R |
| 4,186,846 | 2/1980 | Jacalone | 229/23 R |
| 4,262,837 | 4/1981 | Fremion | 229/15 |

*Primary Examiner*—Herbert F. Ross

*Attorney, Agent, or Firm*—Richard W. Carpenter; Davis Chin

[57] ABSTRACT

A pair of double wall container tubes for fungible products such as peanuts are provided with double thickness joining flaps which with the double thickness walls provide a pair of manufacturer's joints, each of four-ply thickness to give good stacking strength to the loaded container tubes.

2 Claims, 9 Drawing Figures

TWO-CELL BULK CONTAINER TUBES

BACKGROUND OF THE INVENTION

1. Field of the Invention

This invention relates generally to bulk material containers and more particularly, it relates to a container having two cells laminated together along double thickness joining flaps to form a pair of manufacturer's joints of four-ply thickness.

2. Description of Prior Art

A prior art search directed to the subject matter of this application in U.S. Patent and Trademark Office revealed the following U.S. Pat. Nos.

| | | | |
|---|---|---|---|
| RE.21,971 | 3,066,842 | 3,633,794 | 4,091,983 |
| RE.28,439 | 3,114,494 | 3,696,988 | 4,094,455 |
| 1,306,796 | 3,125,274 | 3,701,466 | 4,119,205 |
| 1,612,660 | 3,285,492 | 3,715,072 | 4,154,387 |
| 2,154,085 | 3,347,446 | 3,744,701 | 4,165,030 |
| 2,327,529 | 3,404,806 | 3,744,702 | 4,174,803 |
| 2,491,206 | 3,425,615 | 3,904,105 | 4,177,935 |
| 2,709,547 | 3,493,101 | 4,037,775 | 4,186,846 |
| 3,036,752 | 3,543,991 | 4,046,307 | 4,189,086 |

None of the prior art uncovered in the search disclosed a two-cell bulk container like that of the present invention which provides laminated end walls that extend over the opposite laminated end walls so as to form a pair of manufacturer's joints of four laminae.

SUMMARY OF THE INVENTION

The invention structure relates generally to bulk containers of the kind having a pair of side-by-side cells for loading therein of fungible material such as grain, peanuts or the like.

The loaded material imposes high loads against the sides of the tubes of such containers, and since the loaded tubes are stacked one atop another, not only must each pair of cells take the load therein, but also the loads in the cells superimposed thereon.

Such cells are joined at laminated inner walls, as are also the laminated walls forming the side and end walls, but moreover the end walls are laminated and extend over the opposite laminated end walls and are laminated thereto, so that a pair of manufacturer's joints are provided with four laminae giving improved stacking strength.

DESCRIPTION OF THE PREFERRED EMBODIMENT

Figure 1:
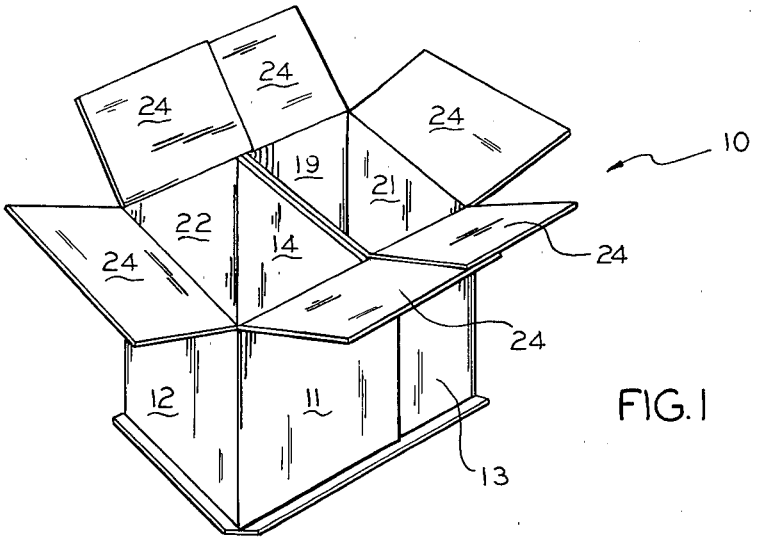
FIG. 1 is a perspective view of a container formed from the container tubes of the present invention, showing closure flaps opened to receive product in the tubes.
Figure 2:
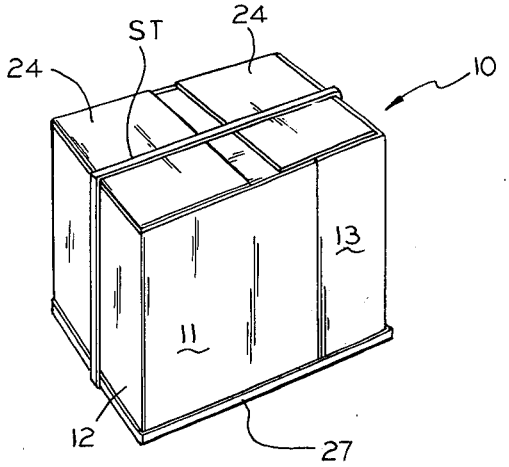
FIG. 2 shows the container of FIG. 1 closed and strapped.
Figure 9:
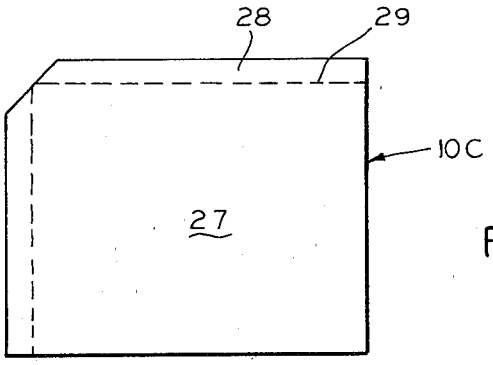
FIG. 9 is a plan view of a scored blank for forming a platen upon which the tubes are disposed for loading.
Figure 7:
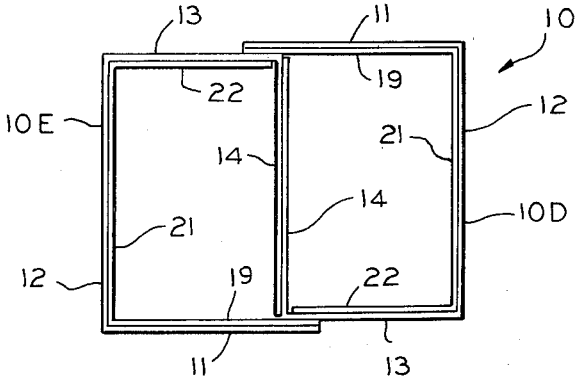
FIG. 7 is a view like FIG. 6 showing the cells in joined relationship.

The two-cell bulk container tubes according to the invention are denoted by reference numerals 10D and 10E as seen in FIG. 7, and these tubes are incorporated into a shipping container 10 seen in FIG. 1 which when loaded and closed is strapped by strap ST. The closed containers may be placed upon a pallet 10C seen in FIG. 9.

The two cells are formed by laminating pairs of blanks 10A and 10B together in a particular fashion so that each cell has a double wall thickness.

Figure 3:
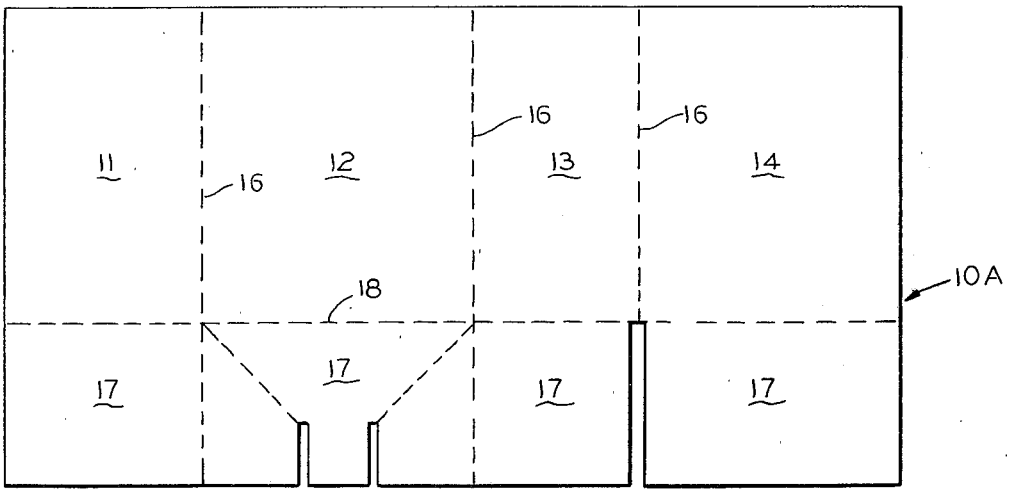
FIG. 3 is a plan view of a cut and scored blank for forming the outer walls of one of the cells of the container tubes.
Figure 4:
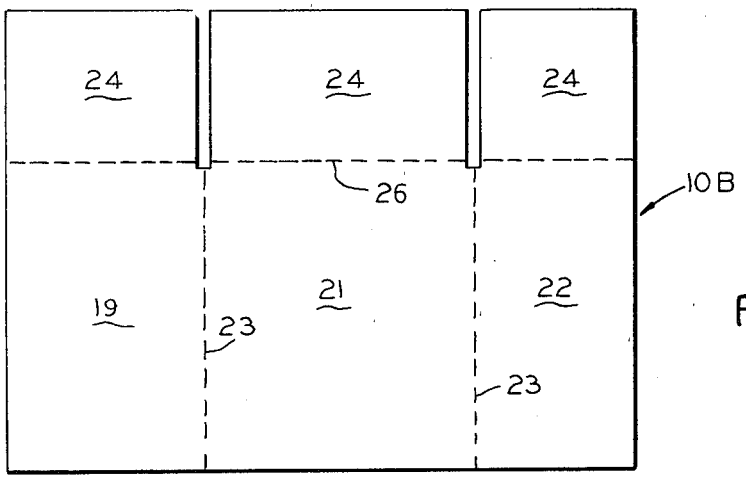
FIG. 4 is a plan view of a cut and scored blank for forming the inner walls of one of the cells of the container tubes.

Blank 10A comprises an outer end wall 11, see FIG. 3, outer side wall 12, opposite end wall 13 and an inner side wall 14, these being connected serially along score lines 16. Closure flaps 17 forming the bottom of tubes 10D and 10E extend from the walls 11 to 14 at a common score line 18. The precise form of flaps 17 is no part of the invention.

Blank 10B is laminated to blank 10A and comprises inner end wall 19, inner side wall 21 and inner end wall 22, these being connected at score lines 23.

Figure 5:
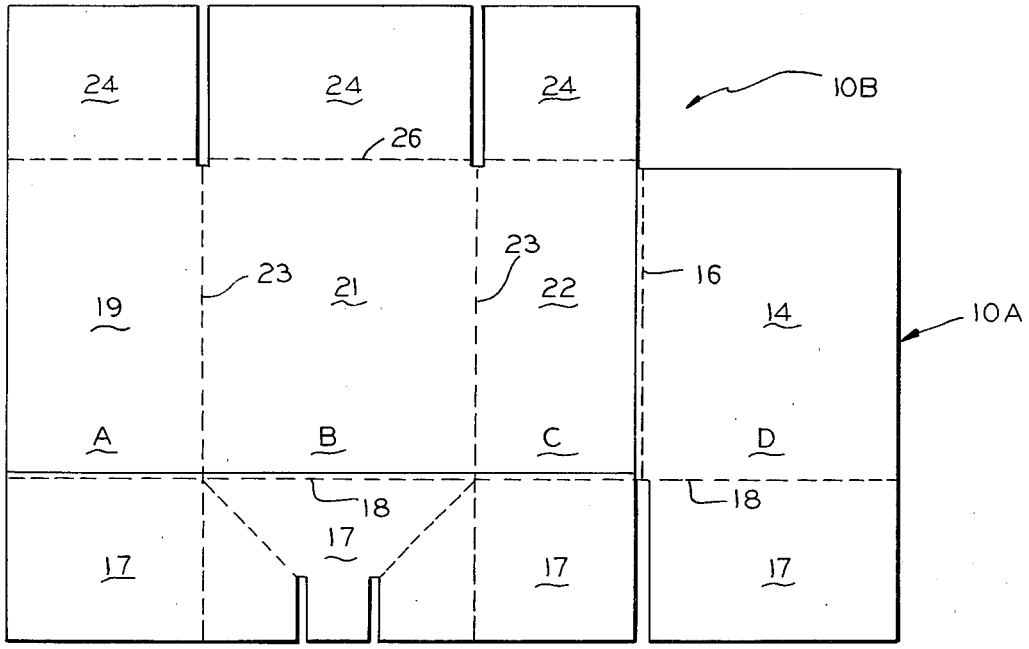
FIG. 5 is a plan view showing the blanks of FIGS. 3 and 4 in laminated relationship to form one of the cells of the container tubes.
Figure 6:
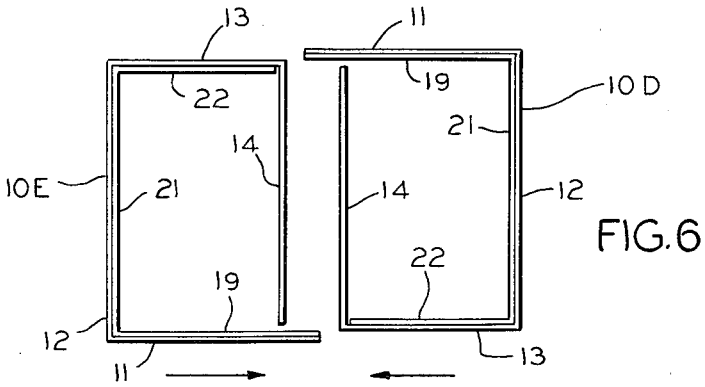
FIG. 6 is a schematic plan view of a pair of cells formed from the blanks of FIGS. 3 and 4 in position to be joined.

As seen in FIGS. 5, 6 and 7, inner wall 19 is laminated to outer end wall 11, inner wall 21 to outer side wall 12, andinner wall 22 to outer end wall 13. Closure flaps 24 extending from walls 19, 21 and 22 along a common score line 26 form a top closure for tubes 10D and 10E. The precise form of these flaps also form no part of the invention. As seen in FIGS. 6 and 7 the blanks 10A and 10B are folded to the position seen along the aligned score lines 16 and 23.

Figure 8:
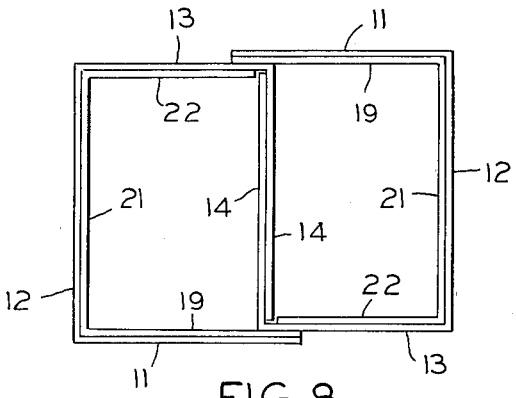
FIG. 8 is a view similar to FIG. 7, but showing a second embodiment of the cells in joined relationship with the inner side wall of one tube fully overlapping the other inner side wall.

Tube 10E is inverted with respect to tube 10D and moved thereaginst, as indicated by the arrows in FIG. 6, to the position seen in FIG. 7. It should be noted that the outer surface of the inner side wall 14 of one tube 10E is disposed in face-to-face relation with the outer surface of the inner side wall 14 of the other tube 10D. Alternately, the inner surface of the inner side wall 14 of one tube is disposed in face-to-face relation with the inner surface of the inner side wall 14 of the other tube so they fully overlap one another by extending over into the opposite tube when laminated. This feature is illustrated clearly in FIG. 8 which shows a double thickness center dividing wall. At the same time walls 11 and 19 of one tube can be laminated to the walls 22 and 13 of the other tube.

The two tubes when so erected provide a pair of cells, each having walls with two thicknesses of board.

At the same time the manufacturer's joints formed by the laminating of walls 11, 19, 13 and 22 are each of four thicknesses of board providing good stacking strength of the tubes.

As seen in FIG. 1, the closure flaps 24 can be folded to closing position, and they can be either glued or held in position by strap ST. The bottoms of tubes 10D and 10E are closed in conventional fashions and container 10 placed on pallet 27 seen in FIG. 9. It has flaps 28 which can fold upward along fold lines 29 enabling the tines of a fork lift to move beneath container 10.

What is claimed is:

1. Two-cell bulk container tubes for a fungible product such as grain comprising:

(a) a pair of congruent tubes adjacent to each other, each being formed from four hingedly connected walls to provide a first inner side wall, opposed outer end walls and an outer side wall;

(b) said opposed outer end and said outer side walls being laminated at the insides thereof to second outer walls conforming to said opposed outer end walls and said outer side wall;

(c) said first inner side walls being laminated together to define a pair of longitudinal cells each having double thickness outer walls and a double thickness common inner wall, the outer surfaces of said first inner side walls being disposed in face-to-face relation to each other; and (d) one of the longitudinal end outer walls of each tube extending in overlying relationship with the laminated outer end wall of the opposite longitudinal end of the adjacent tube and being laminated together to provide a manufacturer's joint composed of four laminae at each longitudinal end of said tubes to give good stacking strength of said tubes when loaded with a fungible product.

2. Two-cell bulk container tubes for a fungible product such as grain comprising:

(a) a pair of congruent tubes adjacent to each other, each being formed from four hingedly connected walls to provide a first inner side wall, opposed outer end walls and an outer side wall;

(b) said opposed outer end and said outer side walls being laminated at the insides thereof to second outer walls conforming to said opposed outer end walls and said outer side wall;

(c) said first inner side walls being laminated together to define a pair of longitudinal cells each having double thickness outer walls and a double thickness common inner wall, the inner surfaces of said first inner side walls being disposed in face-to-face relation so as to fully overlap each other;

(d) one of the longitudinal end outer walls of each tube extending in overlying relationship with the laminated outer end wall of the opposite longitudinal end of the adjacent tube and being laminated together to provide a manufacturer's joint composed of four laminae at each longitudinal end of said tubes to give good stacking strength of said tubes when loaded with a fungible product.

* * * * *